US006855675B1

(12) United States Patent
Yamada et al.

(10) Patent No.: US 6,855,675 B1
(45) Date of Patent: Feb. 15, 2005

(54) LUBRICATING OIL COMPOSITION

(75) Inventors: Michiya Yamada, Saitama-ken (JP); Satoshi Asano, Saitama-ken (JP); Hirotaka Tomizawa, Saitama-ken (JP)

(73) Assignee: TonenGeneral Sekiyu K.K., Tokyo (JP)

( * ) Notice: Subject to any disclaimer, the term of this patent is extended or adjusted under 35 U.S.C. 154(b) by 0 days.

(21) Appl. No.: 08/945,705

(22) PCT Filed: May 24, 1995

(86) PCT No.: PCT/US95/06620

§ 371 (c)(1),
(2), (4) Date: Feb. 24, 1998

(87) PCT Pub. No.: WO96/37582

PCT Pub. Date: Nov. 28, 1996

(51) Int. Cl.[7] ..... C10M 133/56; C10M 133/00; C10M 135/18

(52) U.S. Cl. ..... 508/365; 508/363; 508/364; 508/376; 508/192; 508/295

(58) Field of Search ..... 508/192, 295, 508/363, 365, 376, 364, 378

(56) References Cited

U.S. PATENT DOCUMENTS

| | | | | | |
|---|---|---|---|---|---|
| 3,254,025 | A | * | 5/1966 | LeSuer | |
| 3,509,051 | A | * | 4/1970 | Farmer et al. | |
| 4,178,258 | A | * | 12/1979 | Papay et al. | |
| 4,330,420 | A | * | 5/1982 | White et al. | 508/291 |
| 4,360,438 | A | * | 11/1982 | Rowan et al. | |
| 4,529,526 | A | * | 7/1985 | Inoue et al. | 508/192 |
| 4,692,256 | A | * | 9/1987 | Umemura et al. | |
| 4,846,983 | A | * | 7/1989 | Ward, Jr. | |
| 5,281,347 | A | * | 1/1994 | Igarashi et al. | |
| 5,672,572 | A | | 9/1997 | Arai et al. | 508/364 |
| 5,744,430 | A | | 4/1998 | Inoue et al. | 508/295 |

FOREIGN PATENT DOCUMENTS

| | | | |
|---|---|---|---|
| EP | 0304011 | 2/1989 | C10M/137/10 |
| EP | 0562172 A1 | 9/1993 | C10M/141/08 |
| EP | 0699739 | 3/1996 | C10M/141/10 |
| WO | WO96/06904 | 3/1996 | C10M/141/10 |

OTHER PUBLICATIONS

Robert T. Morrison and Robert N. Boyd (New York University), Organic Chemistry, Third Edition, May 1974, Sec. 3.12, Physical Properties, p. 85.

* cited by examiner

*Primary Examiner*—Cephia D. Toomer
(74) *Attorney, Agent, or Firm*—Joseph J. Allocca; Mark D. Marin

(57) ABSTRACT

A lubricating oil composition that has excellent antiwear properties and is especially useful for internal combustion engine comprises a lubricating base oil and contains the following components: sulfoxymolybdenum dithiocarbamate, zinc dialkyldithiophosphate and a mixture of 100 to 50% by weight of calcium alkylsalicylate and 0 to 50% by weight of magnesium alkylsalicylate, the amount of molybdenum derived from the sulfoxymolybdenum dithiocarbamate being from 200 to 1000 ppm (weight basis) of the total weight of the composition, the amount of phosphorus derived from the zinc dialkyldithiophosphate being from 0.04 to 15% by weight of the total weight of the composition, and the total amount of the calcium alkylsalicylate and the magnesium alkylsalicylate being from 1 to 10% by weight of the total weight of the composition.

5 Claims, No Drawings

LUBRICATING OIL COMPOSITION

BACKGROUND OF THE INVENTION

The present invention relates to a novel lubricating oil composition. More specifically, the present invention relates to a lubricating oil composition having excellent antiwear properties and friction-reducing properties, capable of maintaining the friction-reducing properties, for a prolonged period of time, useful as a lubricating oil for internal-combustion engines, automatic transmission gearboxes, dampers, power steering units and the like, particularly useful as a lubricating oil for internal-combustion engines.

DISCUSSION OF THE RELATED OIL

Lubricating oils have been used for internal-combustion engines, and for driving units and gears such as automatic transmission gearboxes, dampers and power steerings in order to smoothly operate them. In particular, lubricating oils for internal-combustion engines not only lubricate various sliding portions, but also cool the inside of the engines, clean and disperse those products which are produced by combustion, and furthermore prevent the rusting and corrosion of the engines.

In order to meet this requirement, various additives such as an antiwear agent, a metallic detergent, a nonash dispersant and an antioxidant are incorporated into the lubricating oils for internal-combustion engines.

It is particularly important that the lubricating oils ensure the smooth operation of the engines under all operating conditions to prevent the wear and seizure of the engines. The lubricated parts of the engines are, in most cases, under the fluid lubrication condition. However, valve-trains and the top and bottom dead centers of a piston tend to be under the boundary lubrication condition. Antiwear properties under the boundary lubrication condition are generally imparted by the addition of zinc dithiophosphate or zinc dithio-carbamate.

In order to reduce energy lost to friction and to increase fuel economy, a friction modifier is added to lubricating oils. For example, an extreme pressure agent such as a molybdenum compound or a phosphoric ester, or a compound which is an oily agent such as a fatty ester or an alkylamine has been generally used as the friction modifier.

However, while lubricating oil containing such a friction modifier shows the effect of the friction modifier at the outset of the use thereof, it loses the effect when it undergoes oxidative degradation. Namely, the friction-reducing effect of the friction modifier is greatly affected by additives other than the friction modifier, so that it has been difficult for the lubricating oil to maintain, for a long period of time, friction-reducing properties which are shown at the beginning of the operation of an engine.

The present invention has accomplished the objective of developing a lubricating oil (engine oil) which can maintain the effect of reducing friction in engines for a long period of time under these circumstances.

SUMMARY OF THE INVENTION

It has been discovered that a lubricating oil composition having the above described properties is obtained by blending, sulfoxymolybdenum dithio-carbamate having a specific alkyl group, zinc dialkyldithiophosphate having a specific alkyl group, zinc dialkyldithiophosphate having a specific alkyl group, specific alkylsalicylate(s), and, if desired, succinimide containing boron, each in a predetermined amount intra lubricating oil base stock. The present invention has been accomplished on the basis of the above finding.

Namely, the present invention relates to the following lubricating oil compositions:

(1) a lubricating oil composition characterized by comprising a lubricating base oil and additives consisting essentially of:

(a) sulfoxymolybdenum dithiocarbamate containing a hydro-carbon group having 8 to 18 carbon atoms, (b) zinc dialkyldithiophosphate selected from the group consisting of zinc dialkyldithiophosphate containing a primary alkyl group having 1 to 18 carbon atoms, and a mixture of zinc dialkyldithiophosphate containing a primary alkyl group having 1 to 18 carbon atoms and zinc dialkyldithiophosphate containing a secondary alkyl group having 3 to 18 carbon atoms, and (c) a mixture of 100 to 50% by weight of calcium alkylsalicylate and 0 to 50% by weight of magnesium alkylsalicylate, the amount of molybdenum derived from the sulfoxymolybdenum dithiocarbamate being from 200 to 1000 ppm (weight basis) of the total weight of the composition, the amount of phosphorus derived from the zinc dialkyldithio-phosphate being from 0.04 to 0.15% by weight of the total weight of the composition, and the total amount of the calcium alkylsalicylate and the magnesium alkylsalicylate being from 1 to 10% by weight of the total weight of the composition; and (2) a lubricating oil composition characterized by comprising a lubricating base oil and additives consisting essentially of:

(a) sulfoxymolybdenum dithiocarbamate containing a hydro-carbon group having 8 to 18 carbon atoms, (b) zinc dialkyldithiophosphate selected from the group consisting of zinc dialkyldithiophosphate containing a primary alkyl group having 1 to 18 carbon atoms, and a mixture of zinc dialkyldithiophosphate containing a primary alkyl group having 1 to 18 carbon atoms and zinc dialkyldithiophosphate containing a secondary alkyl group having 3 to 18 carbon atoms, (c) a mixture of 100 to 50% by weight of calcium alkylsalicylate and 0 to 50% by weight of magnesium alkylsalicylate, and (d) succinimide containing boron, the amount of molybdenum derived from the sulfoxymolybdenum dithiocarbamate being from 200 to 1000 ppm (weight basis) of the total weight of the composition, the amount of phosphorus derived from the zinc dialkyldithiophosphate being from 0.04 to 0.15% by weight of the total weight of the composition, the total amount of the calcium alkylsalicylate and the magnesium alkylsalicylate being from 1 to 10% by weight of the total weight of the composition, and the amount of boron derived from the succinimide containing boron being from 0.005 to 0.06% by weight of the total weight of the composition.

DETAILED DESCRIPTION OF THE INVENTION

There is no particular limitation on the lubricating base stock oil which is used in the lubricating oil composition of the present invention, and any base oil, such as mineral oil or synthetic oil, which is commonly used for the conventional lubricating basic oils can be used.

Examples of the mineral oil include raffinates which can be obtained by subjecting raw materials for lubricating oils to solvent refining, using an aromatic extraction solvent such as phenol or furfural, hydrogenated oils which can be obtained by subjecting raw materials for lubricating oils to hydrogenation treatment, using a hydrogenation catalyst such as cobalt or molybdenum with a silica-alumina carrier, and lubricating oil fractions which can be obtained by the isomerization of waxes. Suitable base stocks include 60 neutral oil, 100 neutral oil, 150 neutral oil, 300 neutral oil, 500 neutral oil and bright stocks.

Examples of the synthetic oil include poly alpha-olefin oligomers, polybutenes, alkylbenzenes, polyol esters, polyglycol esters, dibasic esters, phosphoric esters and silicone oils. These base oils belonging to mineral oil or synthetic oil can be used either singly or in combination of two or more. Further, a mixture of mineral oil and synthetic oil can also be used.

Those oils which have a viscosity at 100° C. of 3 to 20 cSt are preferable as the base oils for use in the lubricating oil composition of the present invention. Of these, hydrocracked oils and wax-isomerized oils which contain 3% by weight or less of aromatics, 50 ppm or less of sulfur and 50 ppm or less of nitrogen are particularly preferred.

As the sulfoxymolybdenum dithiocarbamate to be incorporated into the lubricant oil composition in accordance with the present invention, use may be made of a compound having the following formula [1]:

[1]

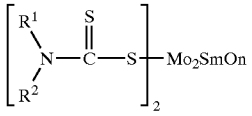

wherein $R^1$ and $R^2$, are independently a hydrocarbon group with 8 to 18 carbon atoms and may or may not be the same, m and n are a positive integer provided that m+n=4.

Examples of the hydrocarbon group having 8 to 18 carbon atoms, represented by $R^1$ and $R^2$ in the general formula [I] include hydrocarbon groups such as an alkyl group having 8 to 18 carbon atoms, an alkenyl group having 8 to 18 carbon atoms, a cycloalkyl group having 8 to 18 carbon atoms, an aryl group having 8 to 18 carbon atoms, an alkylaryl group and an arylalkyl group. The above alkyl and alkenyl groups may be linear or branched. In the lubricating oil composition of the present invention, it is particularly preferable that the hydro-carbon group represented by $R^1$ and $R^2$ have 8 carbon atoms.

Specific examples of the hydrocarbon group represented by $R^1$ and $R^2$ include octyl, nonyl, decyl, undecyl, dodecyl, tridecyl, octenyl, noneyl, decenyl, undecenyl, dodecenyl, tridecenyl, tetradecenyl, hexadecenyl, octadecenyl, dimethylcyclohexyl, ethylcyclohexyl, methylcyclohexylmethyl, cyclohexylethyl, propylcyclohexyl, butylcyclohexyl, heptylcyclohexyl, dimethylphenyl, methylbenzyl, phenethyl, naphthyl and dimethylnaphthyl groups.

In the lubricating oil composition of the present invention, either one or two or more sulfoxymolybdenum dithiocarbamates can be used. Further, the sulfoxymolybdenum dithiocarbamate is incorporated into the composition so that the amount of molybdenum derived from the sulfoxymolybdenum dithiocarbamate can be from 200 to 1000 ppm (weight basis), preferably from 300 to 800 ppm (weight basis) of the total weight of the composition. When the sulfoxymolybdenum dithiocarbamate is incorporated in such an amount that the amount of molybdenum derived from the sulfoxymolybdenum dithiocarbamate is less than 200 ppm (weight basis) of the total weight of the composition, the effect of improving friction-reducing properties cannot be sufficiently obtained. On the other hand, when the sulfoxymolybdenum dithiocarbamate is incorporated in such an amount that the amount of molybdenum derived from the sulfoxymolybdenum dithiocarbamate is in excess of 1000 ppm (weight basis) of the total weight of the composition, the effect which is expected from such an amount of the sulfoxymolybdenum dithiocarbamate cannot be obtained, and sludge or the like tends to be brought about.

As the zinc dialkyldithiophosphate to be incorporated into the lubricant oil composition in accordance with the present invention, use may be made of a compound having the following formula [2]:

[2]

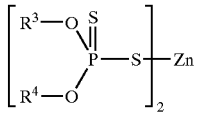

wherein $R^3$ and $R^4$ are independently a primary and secondary alkyl group with 1 to 18, preferably 3 to 18 carbon atoms and may or may not be the same.

In the lubricating oil composition of the present invention, any of the following ones can be used as the zinc dialkyldithiophosphate: zinc dialkyldithiophosphate represented by the general formula [2] in which all of the alkyl groups are primary; a mixture of two zinc dialkyldithiophosphates in which all of the alkyl groups of the first zinc dialkyldithiophosphate are primary and in which one of the alkyl groups of the second zinc dialkyldithiophosphate is primary and the other alkyl group is secondary; zinc dialkyldithiophosphate in which one of the alkyl groups is primary and the other is secondary; zinc dialkyldithiophosphate in which one of the alkyl groups is secondary; and mixtures thereof.

The primary and secondary alkyl groups represented by $R^3$ and $R^4$ in the general formula [2] are propyl, butyl, pentyl, hexyl, heptyl, octyl, nonyl, decyl, undecyl and dodecyl groups. However, zinc dialkyldithiophosphate containing a primary or secondary alkyl group having 3 to 12 carbon atoms is preferably used in the lubricating oil composition of the present invention.

In the lubricating oil composition of the present invention, the zinc dialkyldithiophosphate is incorporated so that the amount of phosphorus derived from the zinc dialkyldithiophosphate can be from 0.04 to 0.15% by weight, preferably from 0.06 to 0.12% by weight of the total weight of the composition. When the zinc dialkyldithiophosphate is incorporated into the composition in such an amount that the amount of phosphorus derived from the zinc dialkyldithiophosphate is less than 0.04% by weight of the total weight of the composition, the resulting composition is poor in antiwear properties, in addition, cannot have a satisfactorily low coefficient of friction under the operating conditions of high oil temperatures and low rotational speeds. On the other hand, when the zinc dialkyldithiophosphate is incorporated in such an amount that the amount of phosphorus derived from the zinc dialkyldithiophosphate is in excess of 0.15% by weight of the total weight of the composition, the effect which is expected from such an amount of the zinc dialkyldithiophosphate cannot be obtained.

As the calcium or magnesium alkylsalicylate to be used in the lubricant oil composition in accordance with the present invention, use may be made of a compound having the following formula [3]:

[3]

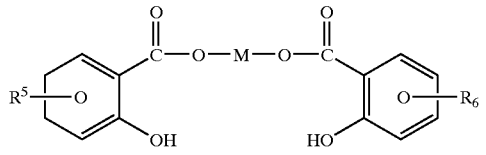

wherein M is calcium or magnesium, and $R^5$ and $R^6$ are independently alkyl group with 8 to 30 carbon atoms and may or may not be the same.

The alkyl group having 8 to 30 carbon atoms represented by $R^5$ and $R^6$ in the general formula [3] may be linear, branched or cyclic one. Examples of such an alkyl group include octyl, nonyl, decyl, dodecyl, pentadecyl, octadecyl, eicosyl, docosyl, tricosyl, hexacosyl, triacontyl, dimethylcyclohexyl, ethylcyclohexyl, methylcyclohexylmethyl and cyclo-hexylethyl groups.

In the lubricating oil composition of the present invention, the alkylsalicylate is incorporated as a mixture of 100 to 50% by weight of calcium alkylsalicylate and 0 to 50% by weight of magnesium alkylsalicylate. The mixture is incorporated in such an amount that the total amount of the calcium alkylsalicylate and the magnesium alkylsalicylate is from 0.5 to 10% by weight, preferably from 1 to 6% by weight of the total weight of the composition. When the total amount of the calcium alkylsalicylate and the magnesium alkylsalicylate is less than 0.5% by weight of the total weight of the composition, cleaning effect cannot be sufficiently obtained. On the other hand, when the total amount of the calcium alkylsalicylate and the magnesium alkylsalicylate is in excess of 10% by weight of the total weight of the composition, the effect which is expected from such an amount of the mixture cannot be obtained, and ash content is rather increased. Such an amount is therefore unfavorable.

In the lubricating oil composition of the present invention, it is preferable to adjust the total base number of the composition to 3 to 10, preferably 4 to 7. The base number of the composition can be determined in accordance with JIS K2501. The total base number of the composition can be adjusted by selecting calcium alkylsalicylate and magnesium alkylsalicylate, each having a proper base number.

Succinimide containing boron can be incorporated into the lubricating oil composition of the present invention, if desired.

The boron/nitrogen ratio regarding the number of the atoms contained in the succinimide containing boron which is used in the lubricating oil composition of the present invention is from 0.05 to 1.5, preferably from 0.1 to 0.8. When the boron/nitrogen ratio is less than 0.05, the resulting composition cannot have sufficiently-improved friction-reducing properties. On the other hand, when the boron/nitrogen ratio exceeds 1.5, the friction-reducing properties of the resulting composition are impaired.

In the lubricating oil composition of the present invention, the succinimide containing boron is incorporated so that the amount of boron derived from the succinimide containing boron can be from 0.005 to 0.06% by weight, preferably from 0.01 to 0.04% by weight of the total weight of the composition. When the succinimide containing boron is used in such an amount that the amount of boron derived from the succinimide containing boron is less than 0.005% by weight of the total weight of the composition, the resulting composition cannot have sufficiently-improved friction-reducing properties. On the other hand, when the succinimide containing boron is used in such an amount that the amount of boron derived from the succinimide containing boron is in excess of 0.06% by weight of the total weight of the composition, the effect which is expected from such an amount of the succinimide containing boron cannot be obtained.

Various additives which have been usually incorporated into the conventional lubricating oils, such as a metallic detergent, another friction modifier, an antioxidant, a viscosity index improver, a pour point depressant, an anti-foaming agent, other antiwear agent(s), a rust preventive, an ashless dispersant and a corrosion inhibitor, can be added, if necessary, to the lubricating oil composition of the present invention within such a limit that the object of the present invention can be fully attained.

Examples of the metallic detergent include calcium sulfonate, magnesium sulfonate, barium sulfonate, calcium phenate, barium phenate, calcium salicylate and magnesium salicylate. In general, the metallic detergent is used in the composition in an amount of 0.1 to 5% by weight.

Examples of the friction modifier include partial esters of polyvalent alcohols, amines, amides and ester sulfides.

Examples of the antioxidant include amine antioxidants such as alkylated diphenylamines, phenyl-alpha-naphthylamines and alkylated alpha-naphthylamines, and phenolic antioxidants such as 2,6-di-t-butyl-4-methylphenol and 4,4'-methylene-bis(2,6-di-t-butylphenol). In general such an antioxidant is used in the composition in an amount of 0.05 to 2% by weight.

Examples of the viscosity index improver include those of polymethacrylate type, polyisobutylene type, ethylene-propylene copolymer type and stryene-butadiene hydrogenated copolymer type. In general, such an improver is used in the composition in an amount of 0.5 to 35% by weight.

Examples of the pour point depressant include polyalkylmethacrylate, a condensation product of chlorinated paraffin and naphthalene and alkylated polystyrene.

Examples of the anti-foaming agent include dimethyl polysiloxane and polyacrylic acid.

Examples of the antiwear agent include metallic salts of thiophosphoric acid, metallic salts of thiocarbamic acid, sulfur compounds, phosphoric esters and phosphorous esters. In general, this agent is used in the composition in an amount of 0.05 to 5.0% by weight.

Examples of the rust preventive additive include fatty acids, partial esters of alkenyl succinates, fatty acid soaps, alkylsulfonates, fatty polyvalent alcohol esters, fatty amines, paraffin oxides and alkyl polyoxyethylene ethers.

Examples of the ashless dispersant include those of succinimide type, succinamide type, benzylamine type and ester type. In general, such a dispersant is used in the composition in an amount of 0.5 to 7% by weight.

Examples of the corrosion inhibitor include benzotriazole and benzoimidazole.

EXAMPLES

The present invention will now be explained more specifically by referring to the following Examples. However, the present invention is not limited by these examples in any way.

The coefficients of friction of the lubricating oil compositions were determined by a reciprocating sliding friction tester [SRV Friction Tester] under the conditions of a frequency of 50 Hz, an amplitude of 3 mm, a load of 25 N, a temperature of 80° C. and a test time of 25 minutes.

Examples 1 to 9 and Comparative Examples 1 and 2

The lubricating oil compositions of these examples are those which contain sulfoxymolybdenum dithiocarbamate, zinc dialkyldithiophosphate and alkylsalicylate. Each lubricating oil composition was prepared by blending the components whose type and amount are shown in Table 1 with a base oil (100 neutral oil having a viscosity at 100° C. of 4.4 mm/s$^2$). The coefficient of friction of each composition thus obtained was determined right after the composition was prepared, and after the composition was oxidized by being held at 150° C. for 72 hours. The results are shown in Table 1.

phate having a secondary alkyl group as the zinc dialkyldithiophosphate, the coefficient of friction determined right after the composition was prepared was already high. Moreover, the coefficient of friction became higher after the composition was heated at 150° C. for 72 hours and oxidized. It can thus be seen that this comparative composition is poor in both friction-reducing properties and heat resistance. In the case of the lubricating oil composition of Comparative Example 2, which was prepared by using calcium sulfonate instead of alkylsalicylate, the coefficient of friction became higher after the composition was heated at 150° C. for 72 hours and oxidized. It can thus be known that this comparative composition is poor in heat resistance.

TABLE 1

| | Example | | | | | | | | | Comparative Example | |
|---|---|---|---|---|---|---|---|---|---|---|---|
| | 1 | 2 | 3 | 4 | 5 | 6 | 7 | 8 | 9 | 1 | 2 |
| Amount of Mo in $C_8$-MoDTC (ppm) | 400 | 800 | — | 400 | 400 | 400 | 400 | 400 | 400 | 400 | 400 |
| Amount of Mo in $C_{13}$-MoDTC (ppm) | — | — | 800 | — | — | — | — | — | — | — | — |
| Amount of phosphorus in $C_8$ ZnDTP (primary) (wt %) | 0.10 | 0.10 | 0.10 | 0.06 | 0.07 | 0.05 | 0.10 | 0.10 | 0.10 | — | 0.10 |
| Amount of phosphorus in $C_3/C_6$ ZnDTP (secondary) (wt %) | — | — | — | — | 0.03 | 0.05 | — | — | — | 0.10 | — |
| Calcium $C_{14}/C_{16}/C_{18}$ salicylate (wt %) | 3.5 | 3.5 | 3.5 | 3.5 | 3.5 | 3.5 | 2.0 | 2.0 | 1.5 | 3.5 | — |
| Magnesium $C_{14}/C_{16}/C_{18}$ salicylate (wt %) | — | — | — | — | — | — | — | 1.0 | 1.5 | — | — |
| Calcium - sulfonate (wt %) | — | — | — | — | — | — | — | — | — | — | 2.0 |
| Succinimide containing boron (wt %) | — | — | — | — | — | — | — | — | — | — | — |
| Coefficient of friction | | | | | | | | | | | |
| Right after preparation | 0.112 | 0.108 | 0.111 | 0.115 | 0.111 | 0.113 | 0.115 | 0.111 | 0.110 | 0.141 | 0.116 |
| After heating at 150° C. for 72 hours | 0.113 | 0.110 | 0.112 | 0.116 | 0.113 | 0.115 | 0.115 | 0.112 | 0.112 | 0.190 | 0.145 |

Note)
$C_8$-MoDTC: sulfoxymolybdenum - N,N-dioctyl-dithiocarbamate
$C_{13}$-MoDTC: sulfoxymolybdenum - N,N-ditridecyl-dithiocarbamate
$C_8$ ZnDTP (primary): zinc di-2-ethylhexyldithiophosphate
$C_3/C_6$ ZnDTP (secondary): zinc isopropyl-1-ethyl-butyldithiophosphate When the lubricating oil compositions of Examples 1 to 9 according to the present invention were used for the determination of the coefficient of friction thereof, it was found that all of the compositions had a low coefficient of friction and excellent friction-reducing properties. Moreover, almost no change was found in the coefficient of friction even after the compositions were heated at 150° C. for 72 hours and oxidized. Therefore, it can be understood that the lubricating oil compositions of the invention are excellent in heat resistance. In contrast, in the case of the lubricating oil composition of Comparative Example 1, which was prepared by using only zinc dialkyldithiophos- Examples 10 to 18 and Comparative Examples 3 and 4

The lubricating oil compositions of these examples are those which contain sulfoxymolybdenum dithiocarbamate, zinc dialkyldithiophosphate, alkylsalicylate and succinimide containing boron. Each lubricating oil composition was prepared by blending the components whose type and amount are shown in Table 2 with a base oil (100 neutral oil having a viscosity at 100° C. of 4.4 mm/s$^2$). The coefficient of friction of each composition thus obtained was determined right after the composition was prepared, and after the composition was oxidized by being held at 150° C. for 72 hours. The results are shown in Table 2.

TABLE 2

| | Example | | | | | | | | | Comparative Example | |
|---|---|---|---|---|---|---|---|---|---|---|---|
| | 10 | 11 | 12 | 13 | 14 | 15 | 16 | 17 | 18 | 3 | 4 |
| Amount of Mo in $C_8$-MoDTC (ppm) | 400 | 800 | — | 400 | 400 | 400 | 400 | 400 | 400 | 400 | 400 |
| Amount of Mo in $C_{13}$-MoDTC (ppm) | — | — | 800 | — | — | — | — | — | — | — | — |
| Amount of phosphorus in $C_8$ ZnDTP (primary) (wt %) | 0.10 | 0.10 | 0.10 | 0.06 | 0.07 | 0.05 | 0.10 | 0.10 | 0.10 | — | 0.10 |
| Amount of phosphorus in $C_3/C_6$ ZnDTP (secondary) (wt %) | | | | | | | | | | 0.10 | |
| Calcium $C_{14}/C_{16}/C_{18}$ salicylate (wt %) | 3.5 | 3.5 | 3.5 | 3.5 | 3.5 | 3.5 | 2.0 | 2.0 | 1.5 | 3.5 | |
| Magnesium $C_{14}/C_{16}/C_{18}$ salicylate (wt %) | | | | | | | 1.0 | 1.5 | | | |
| Calcium - sulfonate (wt %) | | | | | | | | | | | 2.0 |

TABLE 2-continued

| | Example | | | | | | | | | Comparative Example | |
|---|---|---|---|---|---|---|---|---|---|---|---|
| | 10 | 11 | 12 | 13 | 14 | 15 | 16 | 17 | 18 | 3 | 4 |
| Succinimide containing boron (wt %) | 5 | 5 | 5 | 5 | 5 | 5 | 5 | 5 | 5 | 5 | 5 |
| Amount of boron (wt %) | 0.016 | 0.016 | 0.016 | 0.016 | 0.016 | 0.016 | 0.016 | 0.016 | 0.016 | 0.016 | 0.016 |
| Coefficient of friction | | | | | | | | | | | |
| Right after preparation | 0.093 | 0.095 | 0.096 | 0.096 | 0.094 | 0.099 | 0.094 | 0.096 | 0.097 | 0.12 | 0.095 |
| After heating at 150° C. for 72 hours | 0.093 | 0.095 | 0.096 | 0.098 | 0.095 | 0.100 | 0.096 | 0.097 | 0.097 | 0.172 | 0.146 |

Note)
$C_8$-MoDTC: sulfoxymolybdenum - N,N-dioctyl-dithiocarbamate
$C_{13}$-MoDTC: sulfoxymolybdenum - N,N-ditridecyl-dithiocarbamate
$C_8$ ZnDTP (primary): zinc di-2-ethylhexyldithiophosphate
$C_3/C_6$ ZnDTP (secondary): zinc isopropyl-1-ethyl-butyldithiophosphate The lubricating oil compositions of Examples 10 to 18 according to the present invention, into which succinimide containing boron was incorporated, had a coefficient of friction lower than that of any of the lubricating oil compositions of Examples 1 to 9 which contain no succinimide containing boron, and showed excellent friction-reducing properties. Moreover, almost no change was found in the coefficient of friction even after the compositions were heated at 150° C. for 72 hours and oxidized. Therefore, it can be seen that the lubricating oil compositions of the present invention are excellent in heat resistance. In contrast, in the case of the lubricating oil composition of Comparative Example 3, which was prepared by using only zinc dialkyldithiophosphate having a secondary alkyl group as the zinc dialkyldithiophosphate, the coefficient of friction determined right after the composition was prepared was already high, even though succinimide containing boron was incorporated into the composition. Moreover, the coefficient of friction became higher after the composition was heated at 150° C. for 72 hours and oxidized. It can thus be seen that this comparative composition is poor in both friction-reducing properties and heat resistance. In the case of the lubricating oil composition of Comparative Example 4, which was prepared by using calcium sulfonate instead of alkylsalicylate, the coefficient of friction became higher after the composition was heated at 150° C. for 72 hours and oxidized, even though succinimide containing boron was incorporated into the composition. It can thus be known that this comparative composition is poor in heat resistance.

The lubricating oil compositions of the present invention prepared by blending sulfoxymolybdenum dithiocarbamate having a specific structure, zinc dialkyldithiophosphate, alkylsalicylate, and, if desired, succinimide containing boron with a base oil, therefore, have excellent antiwear properties, can maintain friction-reducing properties for a prolonged period of time, and are excellent in both friction-reducing properties and heat resistance. The lubricating oil compositions of the present invention are thus useful as lubricating oils for internal-combustion engines, automatic transmission gearboxes, dampers, power steering units and the like, particularly useful as lubricating oils for internal-combustion engines.

What is claimed is:

1. A method for lubricating an engine so as to maintain the reduction of friction for a prolonged time under the conditions of use in the engine comprising lubricating said engine with a lubricating oil composition comprising a lubricating base oil and (a) sulfoxymolybdenum dithiocarbamate containing a hydrocarbon group having 8 to 18 carbon atoms, (b) a zinc dialkyldithiophosphate component selected from the group consisting of:

(i) zinc dialkyldithiophosphate containing primary alkyl groups having 1 to 18 carbon atoms, (ii) a mixture of zinc dialkyldithiophosphate containing primary alkyl groups having 1 to 18 carbon atoms and zinc dialkyldithiophosphate containing secondary alkyl groups having 3 to 18 carbon atoms, (iii) zinc dialkyldithiophosphate containing primary alkyl groups containing 1 to 18 carbon atoms, and one secondary alkyl group containing 3 to 18 carbons (iv) mixtures thereof, (c) an alkylsalicylate component comprising a mixture of magnesium alkylsalicylate and calcium alkylsalicylate, wherein the magnesium alkylsalicylate does not exceed 50% by weight of said alkylsalicylate component, wherein the amount of molybdenum derived from the sulfoxymolybdenum dithiocarbamate is from 200 to 1000 ppm (weight basis) of the total weight of the composition, the amount of phosphorous derived from the zinc dialkyldithiophosphate component is from 0.04 to 0.15% by weight of the total weight of the composition and the total amount of the alkylsalicylate component is from 0.5 to 10% by weight of the total weight of the composition.

2. A method for lubricating an engine so as to maintain the reduction of friction for a prolonged time under conditions of use in the engine comprising lubricating said engine with a lubricating oil composition comprising a lubricating base oil and:

(a) sulfoxymolybdenum dithiocarbamate containing a hydrocarbon group having 8 to 18 atoms, (b) a zinc dialkyldithiophosphate component selected from the group consisting of:

(i) zinc dialkyldithiophosphate containing primary alkyl groups having 1 to 18 carbon atoms, (ii) a mixture of zinc dialkyldithiophosphate containing primary alkyl groups having 1 to 18 carbon atoms and zinc dialkyldithiophosphate containing secondary alkyl groups having 3 to 18 carbon atoms, (iii) zinc dialkyldithiophosphate containing a primary alkyl groups containing 1 to 18 carbon atoms, and one secondary alkyl group containing 3 to 18 carbons (iv) mixtures thereof, (c) an alkylsalicylate component comprising a mixture of magnesium alkylsalicylate and calcium alkylsalicylate, wherein the magnesium alkylsalicylate does not exceed 50% by weight of said alkylsalicylate component.

(d) succinimide containing boron wherein the amount of molybdenum derived from the sulfoxymolybdenum dithiocarbamate is from 200 to 1000 ppm (weight basis) of the total weight of the composition, the amount of phosphorous derived from the zinc dialkyldithiophosphate component is from 0.04 to 0.15% by weight of the total weight of the composition and the total amount of the alkylsalicylate component is from 0.5 to 10% by weight of the total weight of the composition.

the amount of boron derived from the succinimide containing boron is from 0.005 to 0.06% by weight of the total weight of the composition, and the boron/nitrogen ratio regarding the number of atoms contained in the succinimide contained boron is from 0.05 to 1.5.

3. The method of claim 1 or 2 wherein the lubricating base oil is a hydrocracked oil and/or a wax isomerized oil containing 3% by weight or less aromatics, a sulfur content of 50 ppm or less and a nitrogen content of 50 ppm or less.

4. The method of claim 1 or 2 wherein the primary or secondary alkyl group of the zinc dialkyldithiophosphate contains 3 to 12 carbon atoms.

5. The method of claim 1 or 2 wherein the lubricating oil composition has a total base number of 3 to 10.

* * * * *